US007348722B2

(12) United States Patent
Ahn et al.

(10) Patent No.: US 7,348,722 B2
(45) Date of Patent: Mar. 25, 2008

(54) FIELD EMISSION DEVICE WITH FOCUSING CONTROL ELECTRODE AND FIELD EMISSION DISPLAY

(75) Inventors: Pil-soo Ahn, Suwon-si (KR); Hang-woo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 228 days.

(21) Appl. No.: 11/059,393

(22) Filed: Feb. 17, 2005

(65) Prior Publication Data

US 2005/0189868 A1 Sep. 1, 2005

(30) Foreign Application Priority Data

Feb. 20, 2004 (KR) ..... 10-2004-0011483

(51) Int. Cl.
*H01J 1/62* (2006.01)

(52) U.S. Cl. ..... 313/497; 313/310; 313/309

(58) Field of Classification Search ..... 313/309, 313/336, 351, 495–497, 310; 445/23–25
See application file for complete search history.

(56) References Cited

U.S. PATENT DOCUMENTS 5,070,282 A * 12/1991 Epsztein ..... 315/383
6,624,589 B2 * 9/2003 Kitamura et al. ..... 315/169.3

FOREIGN PATENT DOCUMENTS

JP 9-63467 A 3/1997
JP 10106429 A * 4/1998

* cited by examiner

*Primary Examiner*—Joseph L. Williams
(74) *Attorney, Agent, or Firm*—Sughrue Mion, PLLC

(57) ABSTRACT

A field emission device having a focusing control electrode, and a field emission display (FED) including the same. The field emission device includes a substrate, a cathode electrode formed on the substrate, a focusing control insulating layer formed on the cathode electrode, and having a first cavity that exposes a portion of the cathode electrode, an electron emission source disposed on the cathode electrode that is exposed by the first cavity, a focusing control electrode formed on the focusing control insulating layer and including a focusing control hole aligned with the first cavity, the focusing control electrode controlling the focus of an electron beam emitted from the electron emission source upon applying to the focusing control electrode a voltage that is lower than the potential of the cathode electrode, a gate insulating layer formed on the focusing control electrode, and having a second cavity aligned with the first cavity, and a gate electrode formed on the gate insulating layer, and having a gate hole aligned with the second cavity.

8 Claims, 5 Drawing Sheets

FIELD EMISSION DEVICE WITH FOCUSING CONTROL ELECTRODE AND FIELD EMISSION DISPLAY

BACKGROUND OF THE INVENTION

This application claims the priority of Korean Patent Application No. 2004-11483, filed on Feb. 20, 2004, in the Korean Intellectual Property office, the disclosure of which is incorporated herein in its entirety by reference.

1. Field of the Invention

The present invention relates to a field emission device having a focusing control electrode and a field emission display, and more particularly, to a field emission device having a cathode electrode and a focusing control electrode disposed beneath a gate electrode and a field emission display (FED) including the same.

2. Description of the Related Art

Displays, essential for communicating information, have been adapted for use as personal computer and television monitors. Displays can be grouped into a cathode ray tube (CRT) which operates based on discharge of thermoelectrons at high speed, and a flat panel display which has widely been used in recent years. The flat panel display device includes a liquid crystal display (LCD), a plasma display device (PDP), and a field emission display (FED).

The FED is a display, in which a strong electric field is applied from a gate electrode to electron emission sources arranged on a cathode electrode with predetermined intervals therebetween, thereby emitting electrons from the electron emission sources, and emitting light by collision of the electrons onto a fluorescent material of an anode electrode. A micro tip that is made of a metal such as Mo has typically been used as the electron emission source of the field emission device in the conventional art. However, in recent years the metal tip has been replaced by a carbon nanotube (CNT). The field emission device employing a CNT provides advantages such as a wide viewing angle, high definition, lower power consumption, and temperature stability, and can thus be used in various applications such as car navigation and as a view finder of an electric image apparatus. Especially, the FED can be used as a substitute display for a personal computer, a personal data assistant (PDA) terminal, medical equipment, or high definition television (HDTV).

FIGS. 1 and 2 show two structures of a conventional field emission device.

Referring to FIG. 1, a conventional field emission device includes a substrate 10, a cathode electrode 11 stacked on the substrate 10, a first insulating layer 12, a first gate electrode 13, a second insulating layer 14, and a second gate electrode 15. The first and second insulating layers 12 and 14 have a cavity 17 having a predetermined diameter, and first gate hole 13*a* and a second gate hole 15*a* are formed on the first and second gate electrodes 13 and 15 so as to be aligned with the cavity 17. In addition, an electron emission source 19 is disposed on the cathode electrode 11, which is exposed through the cavity 17. A glass substrate is generally used as the substrate 10, and the cathode electrode 11 is formed of an indium tin oxide (ITO), that is, a conductive transparent material. The electron emission source 19 is generally made of CNT or the metal tip as described above.

Referring to FIG. 2, the conventional field emission device includes a substrate 20, a cathode electrode 21 stacked on the substrate 20, a first insulating layer 22, a first gate electrode 23, a second insulating layer 24, and a second gate electrode 25. In addition, a first cavity 27 and a first gate hole 23*a*, which have the same diameters, are formed on the first insulating layer 22 and the first gate electrode 23, and a second cavity 28 and a second gate hole 25*a*, which have larger diameters than that of the first cavity 27, are formed on the second insulating layer 24 and the second gate electrode 25. The CNT or the metal tip as the electron emission source is disposed inside the first cavity 27.

As shown in FIGS. 1 and 2, the field emission device having a dual-gate electrode structure controls a voltage applied to the second gate electrodes 15 and 25 to prevent an electron beam emitted from the electron emission sources 19 and 20 from diverging. Accordingly, the electron beam can be focused to a desired position with a beam spot of small size, such that higher image quality can be realized. Also, in a field emission display having the above described field emission device, an electric arc generated between the electron emission source and an anode electrode can be discharged through the second gate electrodes 15 and 25 that are arranged closer to the anode electrode. Therefore, the electric arc does not directly affect the electron emission sources 19 and 29 that emit the electron beam, the cathode electrodes 11 and 21, and the first gate electrodes 13 and 23.

Specifically, the field emission device having the structure shown in FIG. 1 having a narrow and deep cavity 17 and the gate holes 13*a* and 25*a* provides enhanced focusing of the electron beam emitted from the electron emission source 19. The field emission device having the structure shown in FIG. 2 has a wide second cavity 28 and a wide second gate hole 25*a*, and can thus be manufactured more easily.

FIG. 3 is a graph illustrating a simulation of electron speed at a position apart from the gate electrode. As shown in FIG. 3, electrons extracted by the gate electrode are accelerated while moving towards the anode electrode which faces the field emission device. Thus, the electron beam is more effectively focused at an initial stage of emission before the electrons are highly accelerated.

In a field emission device having the dual-gate electrode structures shown in FIGS. 1 and 2, the beam can be focused to a greater degree than that of a field emission device having a single gate electrode. However, when the electron beam is focused by a second gate electrode that is 5~10 μm apart from the first gate electrode, it is the accelerated electron beam that is focused. Thus, the focusing efficiency is lowered.

SUMMARY OF THE INVENTION

It is therefore an object of the present invention to provide a field emission device having enhanced focusing capability. The invention has been achieved by disposing a focusing electrode below a gate electrode and close to an electron emission source, which focusing electrode deflects electrons from the electron emission source so as to focus the electron beam at an initial stage of electron beam emission.

The present invention also provides a field emission display (FED) including the above field emission device.

According to a first aspect, the present invention provides a field emission device including: a substrate; a cathode electrode formed on the substrate; a focusing control insulating layer formed on the cathode electrode, and having a first cavity that exposes a portion of the cathode electrode; an electron emission source disposed on the cathode electrode, the electron emission source being exposed by the first cavity; a focusing control electrode formed on the focusing control insulating layer and including a focusing control hole corresponding to (or rather aligned with) the first cavity, said focusing control electrode controlling the focus of an electron beam emitted from the electron emission source upon applying to the focusing control electrode a voltage that is lower than the potential of the cathode electrode; a gate insulating layer formed on the focusing control electrode, and having a second cavity corresponding to the first cavity; and a gate electrode formed on the gate insulating layer, and having a gate hole corresponding to the second cavity.

In a preferred embodiment, an edge of the focusing control electrode facing the electron emission source may be formed at a relative position (x, y) calculated by the following equations, with respect to an upper edge of the electron emission source, $$C/2<x<2C$$

$$-E/2<y<2F/3,$$

where C denotes a radius of the electron emission source, E denotes a height of the electron emission source, and F denotes a height from the upper portion of the electron emission source to the gate electrode.

The voltage applied to the focusing control electrode may be lower than that applied to the gate electrode.

The term "corresponding to", as used herein means "aligned with". For example, as shown in FIG. 4, gate hole 160*a* is vertically aligned with cavity 172 so that the opening of gate hole 160*a* overlaps the opening of cavity 172. The respective openings are preferably but not necessarily concentric.

The focusing control electrode may have a thickness of 100~150 nm.

The electron emission source may comprise a carbon nanotube.

According to another aspect, the present invention provides a field emission display including: a front substrate and a rear substrate facing each other with a predetermined interval therebetween; an anode electrode and a fluorescent layer being sequentially stacked on an inner surface of the front substrate; a cathode electrode formed on the rear substrate; a focusing control insulating layer formed on the cathode electrode, and having a first cavity that exposes a portion of the cathode electrode; an electron emission source disposed on the cathode electrode, said electrode emission source being exposed by the first cavity; a focusing control electrode formed on the focusing control insulating layer, and including a focusing control hole aligned with the first cavity; said focusing control electrode controlling the focus of an electron beam emitted from the electron emission source upon applying to the focusing control electrode a voltage that is lower than the potential of the cathode electrode; a gate insulating layer formed on the focusing control electrode, and having a second cavity aligned with the first cavity; and a gate electrode formed on the gate insulating layer, and having a gate hole aligned with the second cavity.

BRIEF DESCRIPTION OF THE DRAWINGS

The above and other features and advantages of the present invention will become more apparent by the following detailed description of exemplary embodiments with reference to the attached drawings in which.

DETAILED DESCRIPTION OF THE INVENTION

Figure 1:
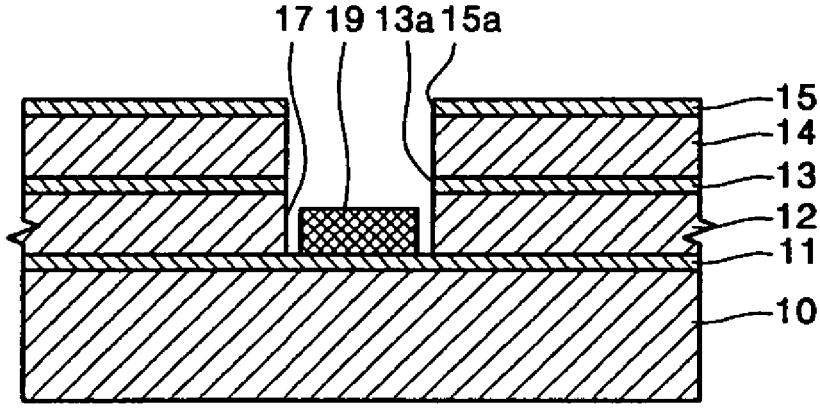
FIG. 1 (PRIOR ART)
FIG. 1 is a cross-sectional view illustrating an example of a conventional field emission device.
Figure 2:
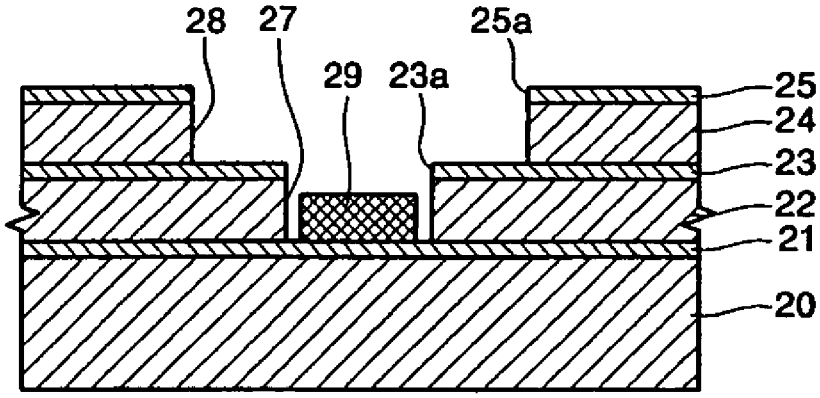
FIG. 2 (PRIOR ART)
FIG. 2 is a cross-sectional view illustrating another example of a conventional field emission device.

Hereinafter, a field emission device having a focusing control electrode and a field emission display (FED) according to the present invention will be described with reference to the accompanying drawings. However, the present invention should not be construed as being limited thereto. In the drawings, the thicknesses of layers and regions are exaggerated for clarity.

Figure 4:
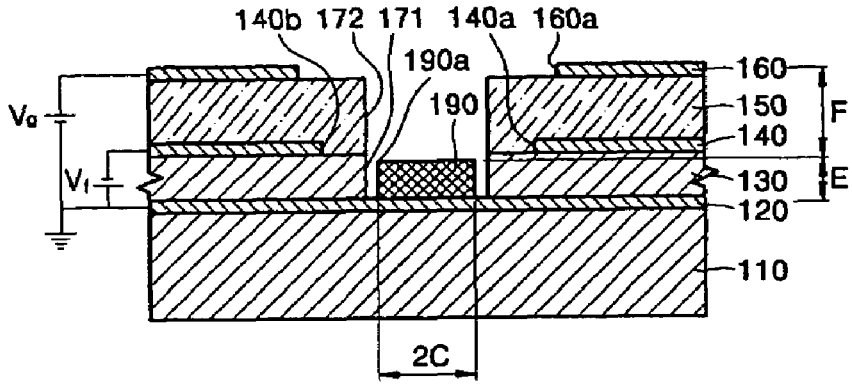
FIG. 4 is a cross-sectional view illustrating a structure of a field emission device according to an exemplary embodiment of the present invention.

FIG. 4 is a cross-sectional view illustrating a structure of a field emission device according to an exemplary embodiment of the present invention.

Referring to FIG. 4, the field emission device according to the present invention includes a substrate 110, a cathode electrode 120 and a focusing control insulating layer 130 that are successively stacked on the substrate 110, and a focusing control electrode 140 disposed on the focusing control insulating layer 130. A gate insulating layer 150 and a gate electrode 160 are sequentially formed on the focusing control electrode 140.

A glass substrate, that is, an insulating material can be used as the substrate 110, and the cathode electrode 120 and the focusing control electrode 140 are manufactured using a conductive material, for example, indium tin oxide (ITO) or chrome (Cr). The electrodes 120 and 140 are desirably formed to have a thickness of about 100~150 nm.

In addition, the focusing control insulating layer 130 and the gate insulating layer 150 respectively have cavities 171 and 172 of predetermined diameters, which expose a portion of the cathode electrode 120. An electron emission source 190 is disposed on the cathode electrode 120 in a portion exposed by the cavities 171 and 172. The cavities 171 and 172 can be formed to have same diameters as each other, or can be formed so that the cavity 172 has larger diameter than that of the cavity 171.

A micro tip formed of a metal such as molybdenum (Mo) can be used as the electron emission source 190, however, a carbon nanotube (CNT) is desirably used as the electron emission source 190. This is because a CNT has advantages such as a wide viewing angle, high definition, low power consumption, and temperature stability.

The focusing control electrode 140 is disposed between the focusing control insulating layer 130 and the gate insulating layer 150. The insulating layers 130 and 150 are formed of silicon oxide. The focusing control insulating layer 130 is desirably formed to a thickness of about 2~3 μm by a deposition method.

In addition, the focusing control electrode 140 includes a focusing control hole 140*a* having a larger diameter than those of the cavities 171 and 172. An edge 140*b* of the focusing control electrode 140 facing an upper edge 190*a* of the electron emission source 190 is desirably disposed at a predetermined position in order to control the focusing of an electron beam emitted from the electron emission source 190. That is, a relative coordinate x of the edge 140*b* of the focusing control electrode 140 with respect to the upper edge 190*a* is preferably within the range of Equation 1.

$$C/2<x<2C \quad (1)$$

Here, C denotes a radius of the electron emission source 190, and x denotes a horizontal distance between the edges 140*b* and 190*a*.

When the value of x increases, a width of the electron beam emitted from the electron emission source 190 increases, and when the value of x decreases, the width of the electron beam emitted from the electron emission source 190 decreases. Also, if the voltage Vf of the focusing control electrode 140 is made more negative so as to control the width of the electron beam, the width of the electron beam can be reduced (by deflecting the electron beam to a greater extent). However, if the distance x between the edges 140*b* and 190*a* is outside the range of Equation 1, it is difficult to control the width of the electron beam by controlling the voltage Vf of the focusing control electrode 140.

Also, a relative coordinate y of the edge 140*b* of the focusing control electrode 140 with respect to the upper edge 190*a* is preferably within the range of the following Equation 2.

$$-E/2<y<2F/3 \quad (3)$$

Here, E denotes a height of the electron emission source 190, and F denotes a vertical distance between an upper portion of the gate electrode 160 and the upper edge 190*a*.

When the value of y increases, the width of the electron beam emitted from the electron emission source 190 is reduced, and when the value of y decreases, the width of the electron beam emitted from the electron emission source 190 increases. Also, if the voltage Vf of the focusing control electrode 140 is made more positive so as to control the width of the electron beam, the width of the electron beam increases.

Therefore, if the edge 140*b* of the focusing control electrode 140 is formed at a predetermined position that is apart from the upper edge 190*a* of the electron emission source 190, the width of the electron beam emitted from the electron emission source 190 can be controlled by controlling the voltage Vf applied to the focusing control electrode.

On the other hand, if the relative distance (x, y) between the two edges 140*b* and 109*a* is outside the ranges of Equation 1 and Equation 2, it is difficult to control the width of the electron beam to 20 μm or less by controlling the voltage of the focusing control electrode 140 in a simulation which is described below.

The voltage Vf applied to the focusing control electrode 140 should be lower than the voltage Vg applied to the gate electrode 160, and should be lower than the voltage (0V in FIG. 4) applied to or assumed by the cathode electrode 120.

The gate electrode 160 is formed on the gate insulating layer 150, and has a gate hole 160*a* that is formed at a position that is aligned with the cavity 172. The diameter of the gate hole 160*a* may be the same as that of the cavity 172, however, the diameter 160*a* is desirably larger than that of the cavity 172. Specifically, the diameter of the gate hole 160*a* is desirably the same as that of the focusing control hole 140*a* or larger.

Figure 5:
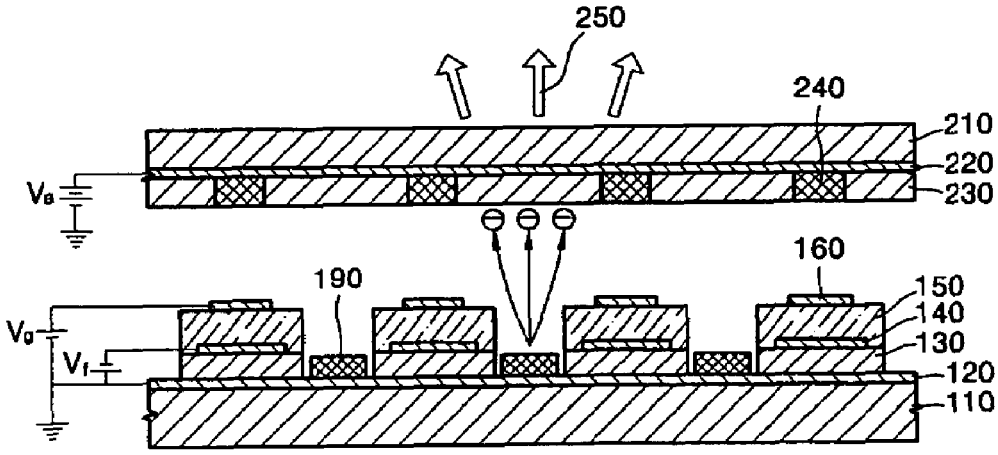
FIG. 5 is a view showing a field emission display (FED) according to another exemplary embodiment of the present invention.

FIG. 5 is a view showing a FED display according to an exemplary embodiment of the present invention, and the same reference numerals denote the same elements as those of the above embodiment and detailed descriptions for those elements will be omitted.

Referring to FIG. 5, the FED display includes an electron emission unit and a light emitting unit. The electron emission unit includes the above field emission device formed on the rear substrate 110.

The light emitting unit includes a front substrate 210, an anode electrode 220 formed on the front substrate 210, and fluorescent layers 230 on the anode electrode 220. A black matrix 240 is disposed between the fluorescent layers 230 for improving chromatic purity.

Operation of the FED display having the above structure will be described with reference to FIG. 5. A pulse voltage Va of 1.5 kV is applied to the anode electrode 220, the cathode electrode 120 is grounded, a negative voltage Vf, for example, −20V is applied to the focusing control electrode 140, and a voltage Vg of 80V is applied to the gate electrode 160. Here, electrons are emitted from the electron emission source 190 by applying the gate voltage Vg. The electrons move to the anode electrode 220 after being focused by the focusing control electrode 140. Thus, the electrons excite the fluorescent layers 230, and the fluorescent layers 230 emit visible rays 250. On the other hand, when the edge 140*b* of the focusing control electrode 140 is formed at the position denoted by Equation 1 or Equation 2 from the electron emission source 190, the width of the electron beam can be controlled by adjusting the negative voltage applied to the focusing control electrode 140.

Figure 6:
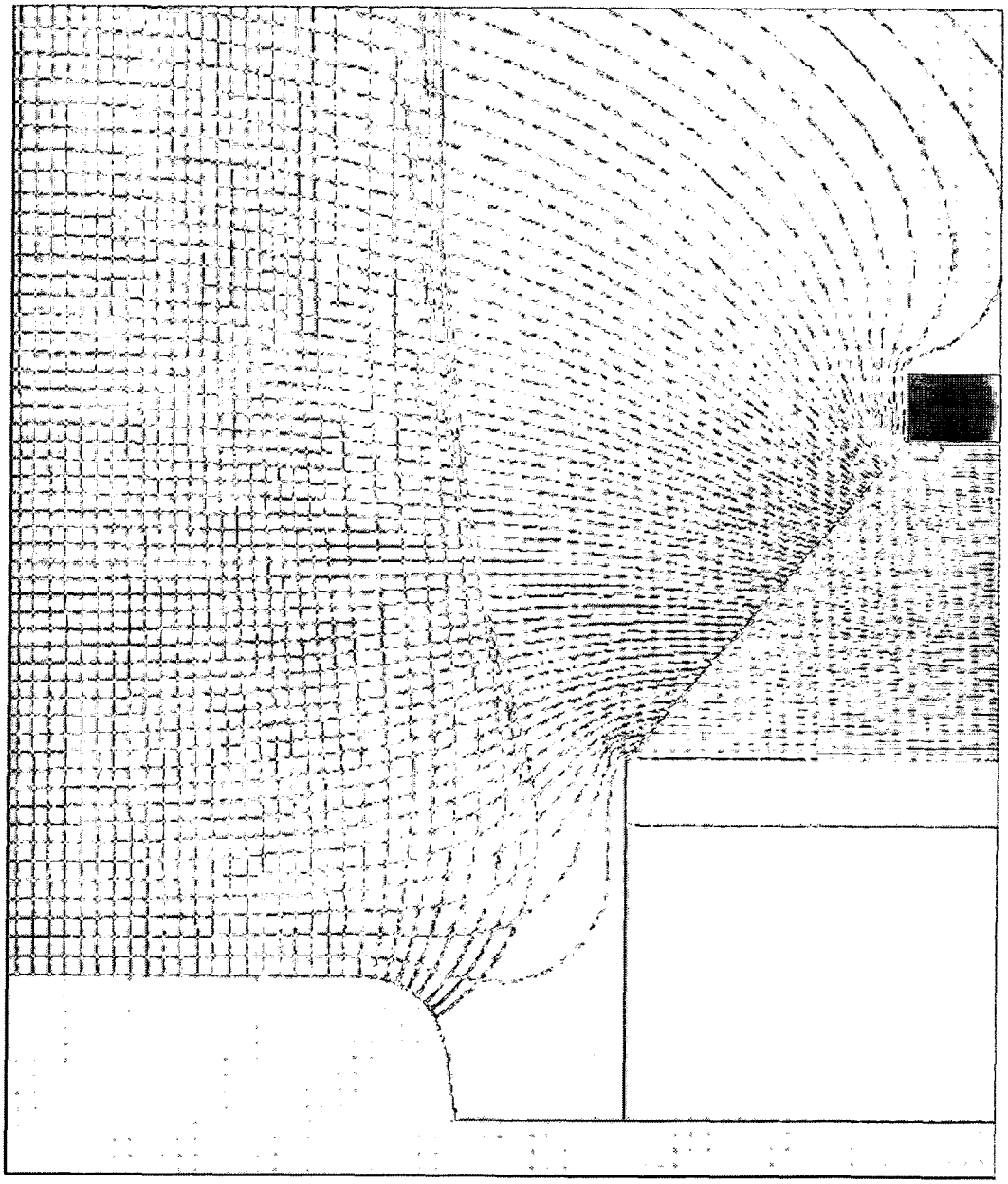
FIGS. 6 and 7 are views showing simulation results of electron beam emission in the FED display shown in FIG. 5 according to the present invention.
Figure 7:
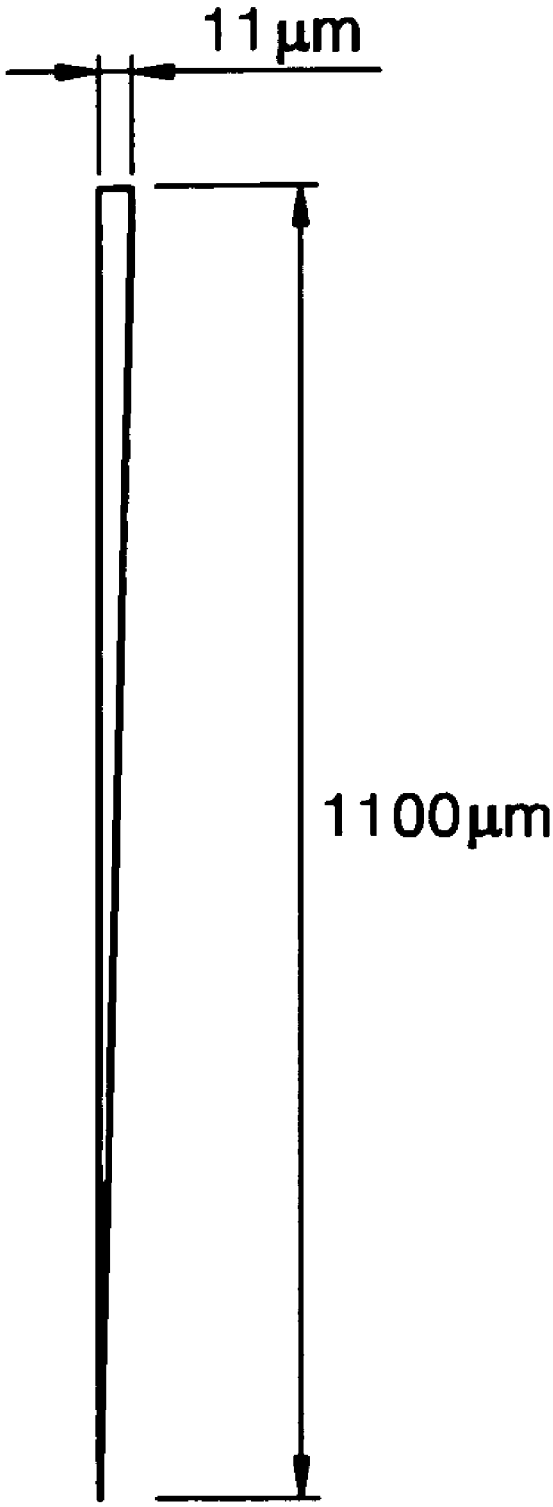

FIGS. 6 and 7 are views showing simulation results of electron beam emission in the FED display of FIG. 5. In the simulation, voltages of 80V and −20V are applied to the gate electrode 160 and the focusing control electrode 140, respectively, and having a return through grounded cathode electrode 120.

Also, the focusing control electrode is separated by 3 μm in the x axis and by 1.5 μm in the y axis from the electron emission source 190, and the gate insulating layer is formed to a thickness of 4 μm.

Figure 3:
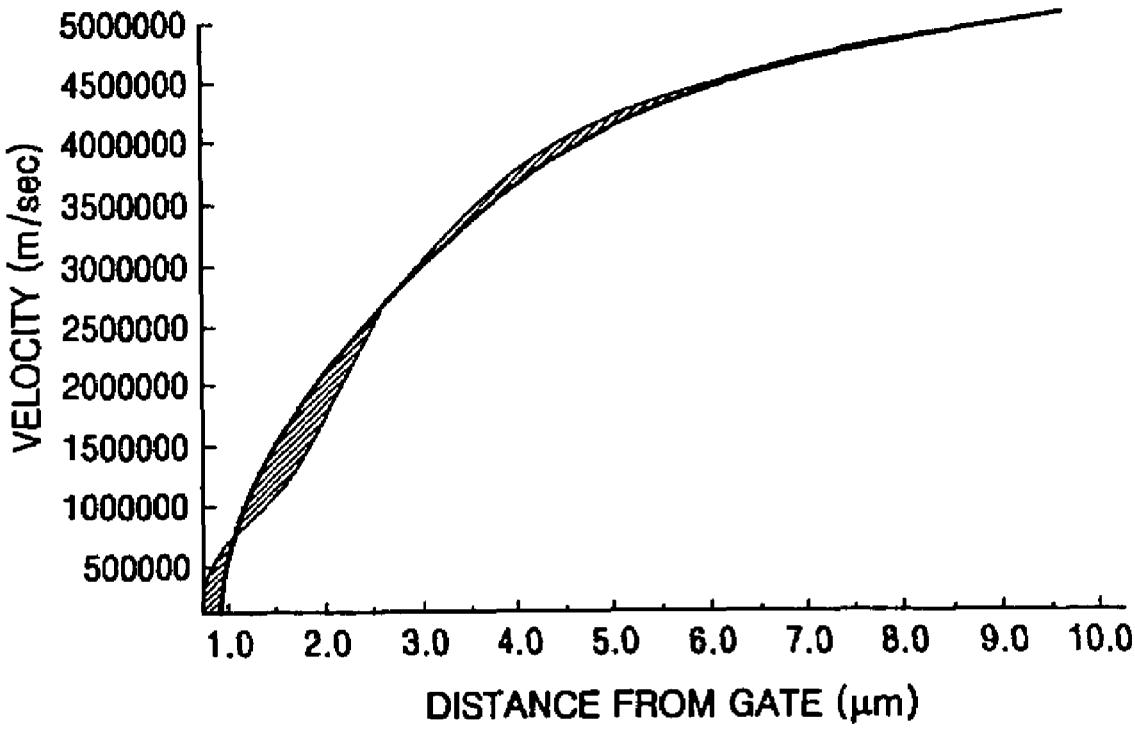
FIG. 3 (PRIOR ART)
FIG. 3 is a graph showing a simulation result of electron speed at a position apart from a gate electrode.

Referring to FIG. 6, the electrons emitted from the electron emission source 190 are focused by the focusing control electrode 140. Since the initial velocity of the emitted electrons is slow as described in reference to FIG. 3, the focusing of electrons can be performed easily.

Referring to FIG. 7, the electron beam is focused on the anode electrode 220 that is 1.1 mm apart from the substrate 110 so that the radius of the electron beam can be 11 μm.

As described above, according to the field emission device of the exemplary embodiments of the present invention, the voltage applied to the focusing control electrode is controlled according to the relative position of the focusing electrode with respect to the electron emission source. Thus, the width of the electron beam can be controlled. In addition, because the electron beam is initially focused while the velocity of the emitted electrons is still relatively low, the field emission device of the invention has improved focusing capability.

According to the FED display having the above field emission device, chromatic purity is improved, and the number of scan lines can be increased relative to that of the conventional art for screens of the same area. Thus, high quality image can be realized.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A field emission device comprising:

a substrate;

a cathode electrode formed on the substrate;

a focusing control insulating layer formed on the cathode electrode, and having a first cavity that exposes a portion of the cathode electrode;

an electron emission source disposed on the cathode electrode, said electron emission source being exposed by the first cavity;

a focusing control electrode formed on the focusing control insulating layer and including a focusing control hole aligned with the first cavity; and means for applying to the focusing control electrode a voltage that is lower than the potential of the cathode electrode so as to control the focus of an electron beam emitted from the electron emission source;

a gate insulating layer formed on the focusing control electrode, and having a second cavity aligned with the first cavity; and a gate electrode formed on the gate insulating layer, and having a gate hole aligned with the second cavity, wherein an edge of the focusing control electrode facing the electron emission source is formed at a relative position, (x, y) calculated by the following equations, with respect to an upper edge of the electron emission source:

$$C/2<x<2C$$

$$-E/2<y<2F/3,$$

wherein C denotes a radius of the electron emission source, E denotes a height of the electron emission source, and F denotes a height from the upper portion of the electron emission source to the gate electrode.

2. The device as claimed in claim 1, which comprises means for applying a voltage to the focusing control electrode that is lower than a voltage that is applied to the gate electrode.

3. The device as claimed in claim 1, wherein the focusing control electrode has a thickness of 100~150 nm.

4. The device as claimed in claim 1, wherein the electron emission source comprises a carbon nanotube.

5. A field emission display comprising:

a front substrate and a rear substrate facing each other with a predetermined interval therebetween;

an anode electrode and a fluorescent layer being sequentially stacked on an inner surface of the front substrate;

a cathode electrode formed on the rear substrate;

a focusing control insulating layer formed on the cathode electrode, and having a first cavity that exposes a portion of the cathode electrode;

an electron emission source disposed on the cathode electrode, said electron emission source being exposed by the first cavity;

a focusing control electrode formed on the focusing control insulating layer, and including a focusing control hole aligned with the first cavity;

means for applying to the focusing control electrode a voltage that is lower than the potential of the cathode electrode so as to control the focus of an electron beam emitted from the electron emission source;

a gate insulating layer formed on the focusing control electrode, and having a second cavity aligned with the first cavity; and a gate electrode formed on the gate insulating layer, and having a gate hole aligned with the second cavity, wherein an edge of the focusing control electrode facing the electron emission source is formed at a relative position (x, y), calculated by the following equations, with respect to an upper edge of the electron mission source, $$C/2<x<2C$$

$$-E/2<y<2F/3,$$

wherein C denotes a radius of the electron emission source, E denotes a height of the electron emission source, and F denotes a height from the upper portion of the electron emission source to the gate electrode.

6. The device as claimed in claim 5, which comprises means for applying a voltage to the focusing control electrode that is lower than that applied to the gate electrode.

7. The device as claimed in claim 5, wherein the focusing control electrode has a thickness of 100~150 nm.

8. The device as claimed in claim 5, wherein the electron emission source comprises a carbon nanotube.

* * * * *